US010352592B2

(12) United States Patent
Lifson et al.

(10) Patent No.: US 10,352,592 B2
(45) Date of Patent: Jul. 16, 2019

(54) EJECTOR SYSTEM AND METHODS OF OPERATION

(71) Applicant: Carrier Corporation, Jupiter, FL (US)

(72) Inventors: Alexander Lifson, Manlius, NY (US); Zuojun Shi, Marcellus, NY (US); Hans-Joachim Huff, Mainz (DE); Parmesh Verma, South Windsor, CT (US); Thomas D. Radcliff, Vernon, CT (US); Frederick J. Cogswell, Glastonbury, CT (US); Jinliang Wang, Ellington, CT (US); Hongsheng Liu, Shanghai (CN)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/576,474

(22) PCT Filed: May 26, 2016

(86) PCT No.: PCT/US2016/034296

§ 371 (c)(1),
(2) Date: Nov. 22, 2017

(87) PCT Pub. No.: WO2016/191541

PCT Pub. Date: Dec. 1, 2016

(65) Prior Publication Data

US 2018/0156499 A1 Jun. 7, 2018

(30) Foreign Application Priority Data

May 27, 2015 (CN) ..... 2015 1 0276827

(51) Int. Cl.

| | |
|---|---|
| ***F25B 9/00*** | (2006.01) |
| ***F25B 41/00*** | (2006.01) |
| ***F25B 41/04*** | (2006.01) |

(52) U.S. Cl.
CPC ..... *F25B 9/008* (2013.01); *F25B 41/00* (2013.01); *F25B 41/003* (2013.01);
(Continued)

(58) Field of Classification Search
CPC .. F25B 5/02; F25B 9/008; F25B 9/006; F25B 41/00; F25B 2341/0012; F25B 2341/0015; F25B 2400/075
See application file for complete search history.

(56) References Cited

U.S. PATENT DOCUMENTS

| | | | |
|---|---|---|---|
| 1,836,318 | A | 12/1931 | Gay |
| 3,277,660 | A | 10/1966 | Kemper et al. |

(Continued)

FOREIGN PATENT DOCUMENTS

| | | | |
|---|---|---|---|
| FR | 2844036 | A1 | 3/2004 |
| JP | 09318169 | A | 12/1997 |

(Continued)

OTHER PUBLICATIONS

International Search Report and Written Opinion for PCT/US2016/034296, dated Aug. 17, 2016.

(Continued)

*Primary Examiner* — Elizabeth J Martin
(74) *Attorney, Agent, or Firm* — Bachman & LaPointe, P.C.

(57) ABSTRACT

A vapor compression system (200; 300; 400) has: a compressor (22); a first heat exchanger (30); a second heat exchanger (64); an ejector (38); separator (48); and an expansion device (70). A plurality of conduits are positioned to define a first flowpath sequentially through: the compressor; the first heat exchanger; the ejector from a motive flow inlet through (40) an outlet (44); and the separator, and then branching into: a first branch returning to the compressor; and a second branch passing through the expansion device (Continued)

and second heat exchanger to a secondary flow inlet (42). The plurality of conduits are positioned to define a bypass flowpath (202; 302; 402) bypassing the motive flow inlet and rejoining the first flowpath at essentially separator pressure but away from the separator.

21 Claims, 4 Drawing Sheets

(52) U.S. Cl.
CPC ..... *F25B 41/043* (2013.01); *F25B 2309/06* (2013.01); *F25B 2341/0012* (2013.01); *F25B 2400/0407* (2013.01); *F25B 2400/23* (2013.01); *F25B 2600/2501* (2013.01)

(56) References Cited

U.S. PATENT DOCUMENTS

| | | | |
|---|---|---|---|
| 6,584,794 | B2 | 7/2003 | Takeuchi et al. |
| 6,782,713 | B2 | 8/2004 | Takeuchi et al. |
| 6,837,069 | B2 | 1/2005 | Takeuchi et al. |
| 6,904,766 | B2 | 6/2005 | Ito et al. |
| 6,945,074 | B2 | 9/2005 | Sato et al. |
| 7,207,186 | B2 | 4/2007 | Hirota |
| 7,299,645 | B2 | 11/2007 | Oshitani et al. |
| 7,367,200 | B2 | 5/2008 | Ikegami et al. |
| 7,520,142 | B2 | 4/2009 | Saito et al. |
| 8,713,962 | B2 | 5/2014 | Okazaki |
| 2004/0040340 | A1* | 3/2004 | Takeuchi ..... B60H 1/3204 62/500 |
| 2004/0255602 | A1 | 12/2004 | Sato et al. |
| 2013/0042640 | A1 | 2/2013 | Higashiiue et al. |
| 2013/0125569 | A1 | 5/2013 | Verma et al. |
| 2013/0213083 | A1 | 8/2013 | Higashiiue et al. |

FOREIGN PATENT DOCUMENTS

| | | | |
|---|---|---|---|
| JP | 2003074992 | A | 3/2003 |
| JP | 2003097868 | A | 4/2003 |
| JP | 2015004460 | A | 1/2015 |
| WO | 2013/002872 | A2 | 1/2013 |

OTHER PUBLICATIONS

Singapore Office Action dated Jul. 17, 2018 for Singapore Patent Application No. 11201709618X.

* cited by examiner

EJECTOR SYSTEM AND METHODS OF OPERATION

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. FIG. 1 shows one basic example of an ejector refrigeration system (vapor compression system) 20. The system includes a compressor 22 having an inlet (suction port) 24 and an outlet (discharge port) 26. The compressor and other system components are positioned along a refrigerant circuit or flowpath 27 and connected via various conduits (lines). Exemplary refrigerant is carbon dioxide ($CO_2$)-based (e.g., at least 50% by weight). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas or vapor outlet 54. A suction line 56 extends from the gas outlet 54 to the compressor suction port 24. The lines 28, 36, 46, 56, and components therebetween define a primary loop 60 of the refrigerant circuit 27.

From the separator, the flowpath branches into a first branch 61 completing the primary loop 60 to return to the compressor and a second branch 63 forming a portion of a secondary loop 62. The secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62. An expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet (exit) 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary inlet and secondary inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (exemplary temperature sensors 150, 152, 154, 156 and pressure sensors 160, 162, 164, 166 shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

A further variation is shown in Ozaki et al. JP2003-074992A, published Mar. 12, 2003. Ozaki et al shows a bypass flowpath from upstream of the motive nozzle to downstream of the expansion device. An alternative bypass destination is to the separator in the absence of an expansion device.

SUMMARY

One aspect of the disclosure involves a vapor compression system comprising: a compressor; a first heat exchanger; a second heat exchanger; an ejector comprising; a separator; and an expansion device. The ejector comprises: a motive flow inlet; a secondary flow inlet; and an outlet. The separator has: an inlet; a liquid outlet; and a vapor outlet.

A plurality of conduits are positioned to define a first flowpath sequentially through: the compressor; the first heat exchanger; the ejector from the motive flow inlet through the ejector outlet; and the separator, and then branching into: a first branch returning to the compressor; and a second branch passing through the expansion device and second heat exchanger to the secondary flow inlet. The plurality of conduits are positioned to define a bypass flowpath bypassing the motive nozzle and rejoining the first flowpath at essentially separator pressure but away from the separator.

In one or more embodiments of the other embodiments, the plurality of conduits are positioned so that the bypass flowpath rejoins the first flowpath upstream of the separator inlet.

In one or more embodiments of the other embodiments, the plurality of conduits are positioned so that the bypass flowpath rejoins the first flowpath upstream of the separator inlet by at a distance equal to four times to one hundred times an effective diameter of a flowpath entering the separator.

In one or more embodiments of the other embodiments, the plurality of conduits are positioned so that the bypass flowpath rejoins the second branch downstream of the separator liquid outlet and upstream of the expansion device.

In one or more embodiments of the other embodiments, the plurality of conduits are positioned so that the bypass flowpath rejoins the first branch downstream of the separator vapor outlet and upstream of the compressor inlet.

In one or more embodiments of the other embodiments, the ejector comprises a control needle movable between a first position and a second position.

In one or more embodiments of the other embodiments, a pressure regulator is disposed along the bypass flowpath.

In one or more embodiments of the other embodiments, the pressure regulator is a variable orifice expansion valve.

In one or more embodiments of the other embodiments, a variable orifice electronic expansion valve is disposed along the bypass flowpath.

In one or more embodiments of the other embodiments, a bistatic on-off valve is disposed along the bypass flowpath.

In one or more embodiments of the other embodiments, a controller is configured over at least a portion of an operating regime for pulse width modulated operation of the bistatic on-off valve.

In one or more embodiments of the other embodiments, a controller is configured to, over at least a portion of an operating regime: with increasing total flow through the heat rejection heat exchanger, increasing a fraction of the total flow passed along the bypass flowpath.

In one or more embodiments of the other embodiments, the controller is configured to: over said portion, increase the flow along the bypass flowpath responsive to increased high side pressure.

In one or more embodiments of the other embodiments, the controller is configured to: over said portion, increase a fraction of the total flow passed along the bypass flowpath so as to reduce a compressor temperature.

In one or more embodiments of the other embodiments, a refrigerant charge comprises at least 50% by weight carbon dioxide.

Another aspect of the disclosure involves a method for operating the vapor compression system. The method comprises, over at least a portion of an operating regime: with increasing total flow through the heat rejection heat exchanger, increasing a fraction of the total flow passed along the bypass flowpath.

In one or more embodiments of the other embodiments, the increasing the fraction of the total flow passed along the bypass flowpath is responsive to increased sensed high side pressure.

In one or more embodiments of the other embodiments, a method for operating the vapor compression system comprises, over at least a portion of an operating regime: increasing a fraction of the total flow passed along the bypass flowpath so as to reduce a compressor temperature.

In one or more embodiments of the other embodiments, the increasing the fraction of the total flow passed along the bypass flowpath is responsive to increased sensed compressor discharge temperature.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
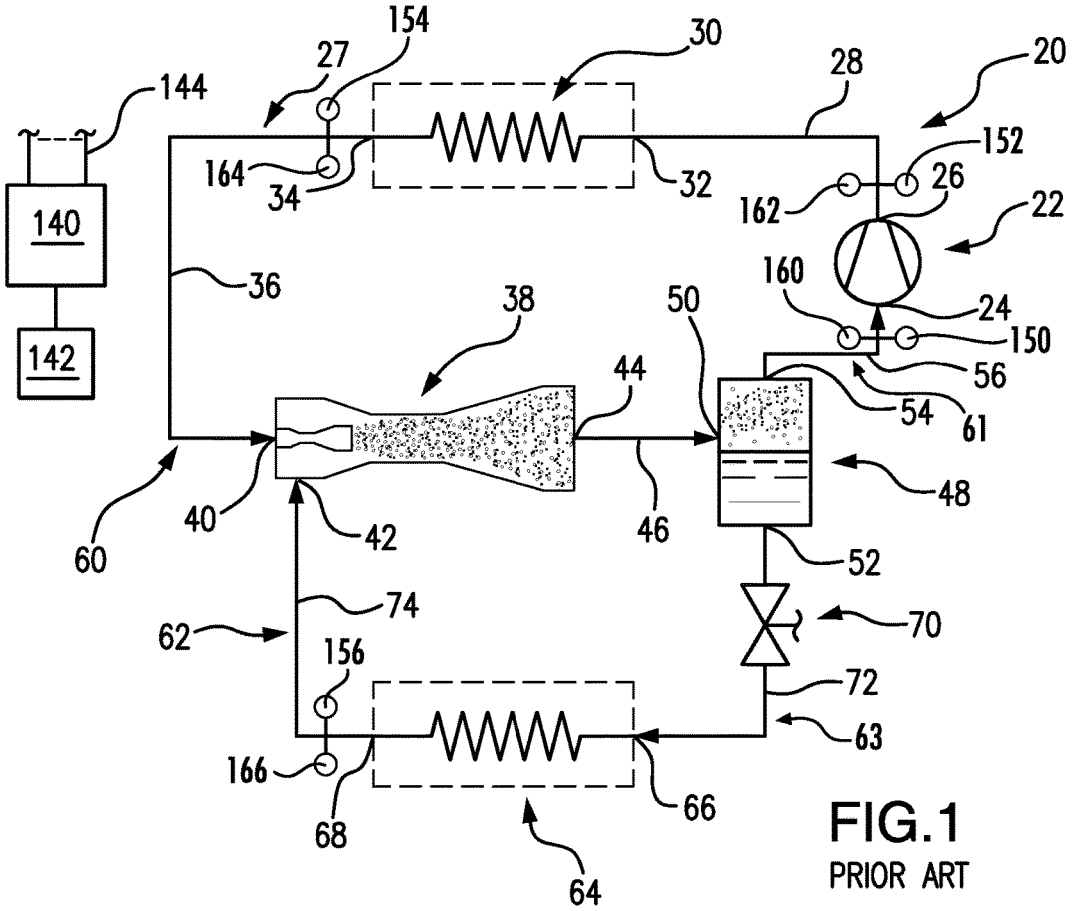
FIG.1 PRIOR ART
FIG. 1 is a schematic view of a prior art ejector refrigeration system.
Figure 2:
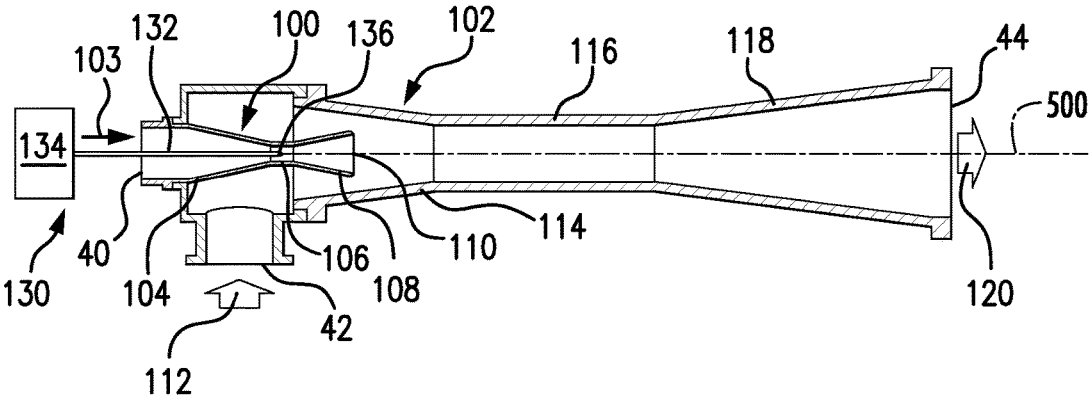
FIG. 2 PRIOR ART
FIG. 2 is an axial sectional view of a prior art ejector.
Figure 3:
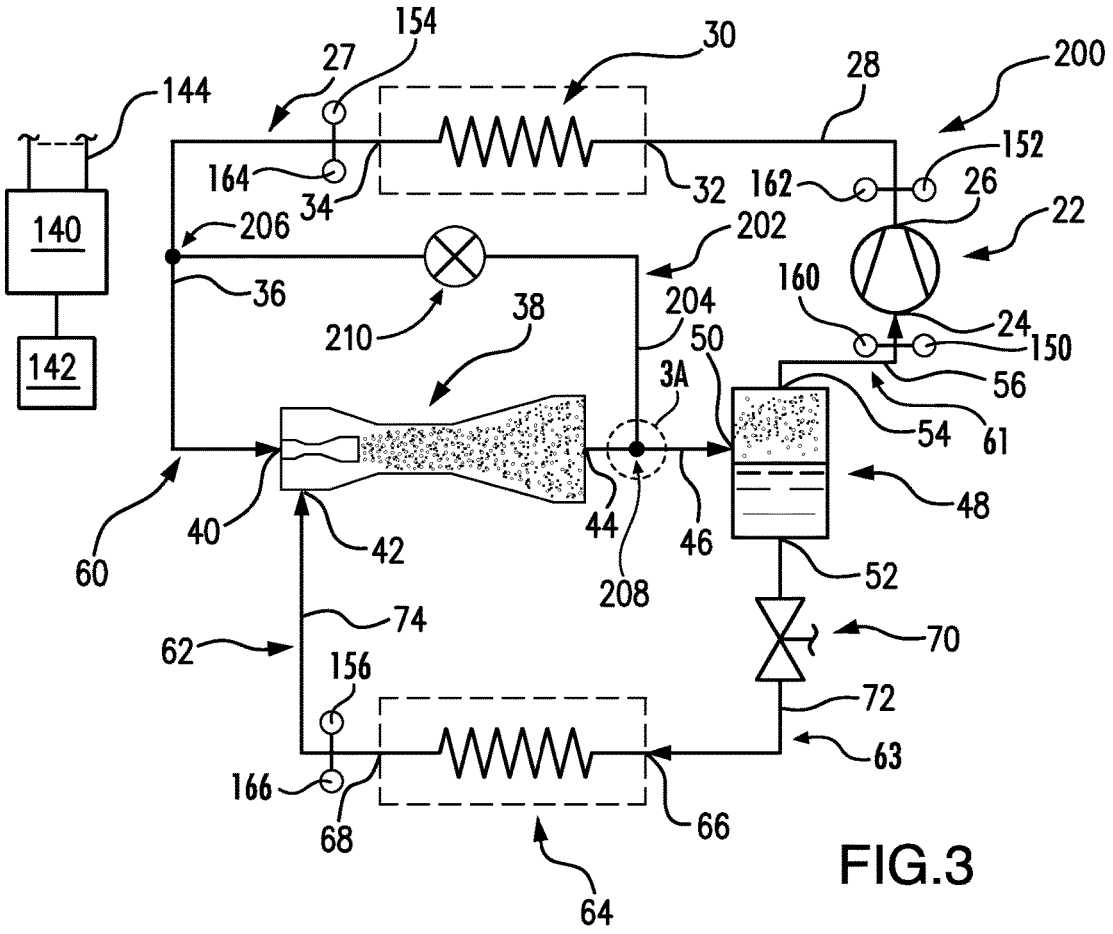
FIG. 3 is a schematic view of a second ejector refrigeration system.

FIG. 3 shows a second vapor compression system 200 which may otherwise be similar to the system 20. However, the system 200 adds a bypass flowpath 202 bypassing the ejector 38. In this embodiment, the bypass flow can be in fluid communication directly with the ejector outlet 44 (e.g., the diffuser outlet) and/or directly with the separator inlet 50. More particularly, the bypass flowpath bypasses the ejector motive nozzle. As is discussed further below, the bypass flowpath may be added in a reengineering of a baseline system without such a bypass flowpath. The baseline system may have an ejector (in particular the motive nozzle) sized to handle the maximum anticipated refrigerant flow rate through the compressor and heat rejection heat exchanger (e.g., a 100% load condition). Such an ejector or motive nozzle may be relatively inefficient at normal/typical load conditions. The reengineering may replace the baseline ejector with a smaller ejector (e.g., having a smaller motive nozzle throat cross-sectional area) that is more efficient at normal operating conditions than is the baseline ejector.

In some examples, the replacement ejector can have a motive nozzle cross-sectional area of 40% to 90% that of the baseline ejector, for example, 50% to 80%, or 70%. Addition of the bypass flowpath allows unloading the ejector if needed. For example, reasons for unloading the ejector can include relieving pressure of the high side components when the pressure relieved by fully withdrawing the control needle is insufficient (e.g., to prevent damage of the heat rejection heat exchanger), increasing efficiency (e.g., in some cases a more efficient operation of the ejector may occur with some bypass), or a combination including at least one of the foregoing.

In the illustrated embodiment, the bypass flowpath comprises a bypass line 204 extending from a first location 204 upstream of the motive nozzle along the primary flowpath/loop 60 to a second location 208. In the illustrated embodiment, the second location 208 is also along the primary loop/flowpath 60. More particularly, the exemplary location 208 is between the ejector outlet 44 and separator inlet 50.

A flow control device 210 is positioned to control flow along the bypass flowpath 200. Exemplary flow control devices include a valve (e.g., an electronically controlled valve), a mass flow controller, a pressure regulator, a flow orifice, or a combination including at least one of the foregoing. One example of an electronically controlled valve is a pulse width modulated (PWM) valve (e.g., on-off solenoid valve) under control of the controller 140. Exemplary pressure regulators are variable valves. Examples of such valves may be directly controlled via a pressure and/or a temperature sensor. For example, there may be direct control responsive to a pressure sensor 164 or 166 at the heat exchanger 30 or 64. If at the heat exchanger 30, the valve may be set up so that pressure increase causes corresponding increase in valve opening area to relieve that pressure at the heat rejection heat exchanger 30. If at the evaporator 64, control may be inverted. Namely, a decrease in pressure at the evaporator 64 may cause an opening of the valve 210. This may be useful to cause an increase in refrigerant flow delivered to the evaporator 64 and thus may cause an increase in evaporator temperature to avoid freezing while also reducing the pressure at the heat rejection heat exchanger 30. Other variable valves are pulse width modulated valves which may be controlled by the controller as noted above responsive to input from sensors at locations such as the heat exchangers.

A yet further variation might involve a non-PWM bi-static on-off valve. However, in some cases such embodiments may limit flexibility to control the refrigerant system (e.g., pressure and/or temperatures at selected regions of the system) which may be undesirable.

Numerous control variations are possible. For example, in reengineering a baseline system, control of the bypass may piggy back on some other control aspect. For example the baseline system's programming may include control of compressor speed. The bypass may be controlled directly as a function of compressor speed (and thus indirectly as a function of whatever parameters were used by the controller to determine that speed).

Relative to the Ozaki et al. embodiment bypassing to the separator, embodiments of the FIG. 3 system 200 may have one or more of several advantages from the positioning of location 208 upstream of the separator. By moving the mixing of the bypass flow and the main flow to upstream of the separator, these flows are allowed to mix and enter the separator inlet 50 in a more stable condition (to provide that the flow is fully developed before entering the separator). This is contrasted with mixing the two flows in the separator wherein it may become more difficult to separate phases (e.g., due to turbulent flow characteristics). Thus, in one example, the location 208 is upstream of the inlet 50 by at least at least four times a diameter (internal diameter (ID)) of the flowpath entering the separator inlet (e.g., a conduit internal cross-sectional area). For hypothetically non-circular sections, the distance may be measured relative to the effective diameter, a diameter of a circle of the same cross-sectional area. A greater range on this dimension is at least five times or at least ten times, but not more than one hundred times.

Figure 3A:
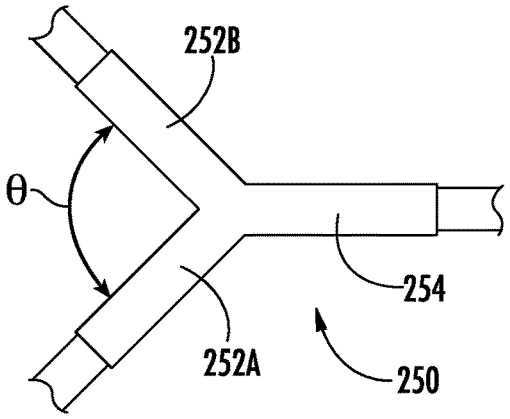
FIG. 3A is an enlarged view of a junction in the second ejector refrigeration system.

In certain embodiments, the bypass and main flow may mix in a Y-fitting 250 (FIG. 3A) (forming the location or junction 208). The flows enter end ports of respective arms 252A (main), 252B (bypass) of the fitting and mix in and exit from the end of the leg 254). Similar fittings may be used in implementations of the FIG. 4 and FIG. 5 systems below. In the illustrated example, the arms are at an angle θ from each other and θ/2 from a projection of the leg (in which case exemplary θ is up to 120°, more particularly, up to 90° or up to 60° or up to 45° or up to 30°). Alternatives might have one of the arms in-line with the leg (in which case exemplary θ is up to 90°, more particularly, up to 45° or up to 30°). This may provide a smoother, mixing of the flows with less energy loss or pressure disruption. Although the two arms are shown of similar size, they may be different (e.g., a smaller cross-sectional area for the bypass branch).

Figure 4:
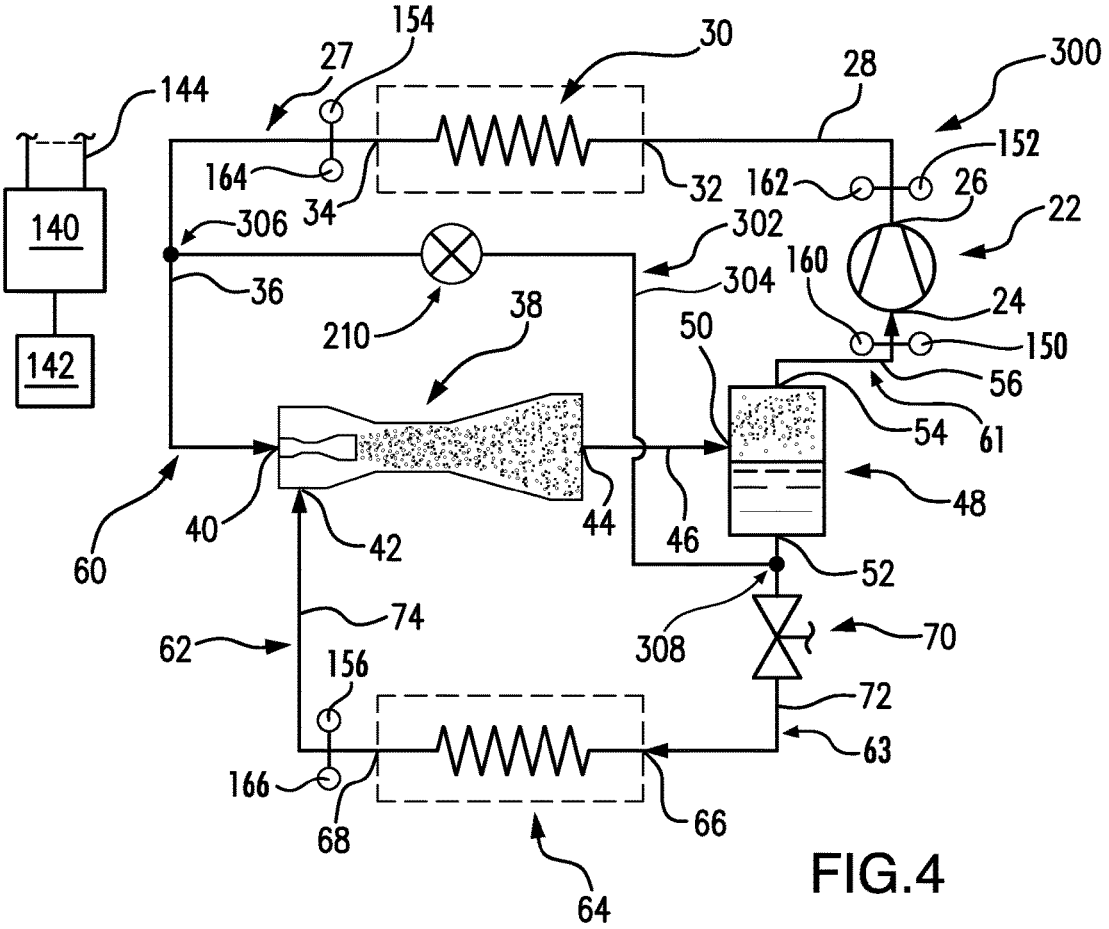
FIG. 4 is a schematic view of a third ejector refrigeration system.

FIG. 4 shows a system 300 which may be otherwise similar to the system 200 with a bypass flowpath 302 having a line 304 extending from a similar upstream location 306 but to a downstream location 308. The exemplary downstream location 308 is, however, downstream of the separator outlet 52 and upstream of the expansion device 70 along the secondary loop 62 and second branch 63. In this embodiment, the bypass flow can be in fluid communication directly with an inlet of the expansion device 70.

Control may be otherwise similar to that mentioned above for FIG. 3.

Relative to the Ozaki et al. embodiment bypassing to the separator, embodiments of the FIG. 4 system 300 may allow a smaller separator to be used. Relative to the Ozaki et al. embodiment bypassing to downstream of the expansion device 70, the FIG. 4 embodiment may allow improved mixing and flow uniformity (e.g., as the relative proportions of the bypass flow and main flow change, there will be a lesser variation in the properties of the flow exiting the expansion device).

Figure 5:
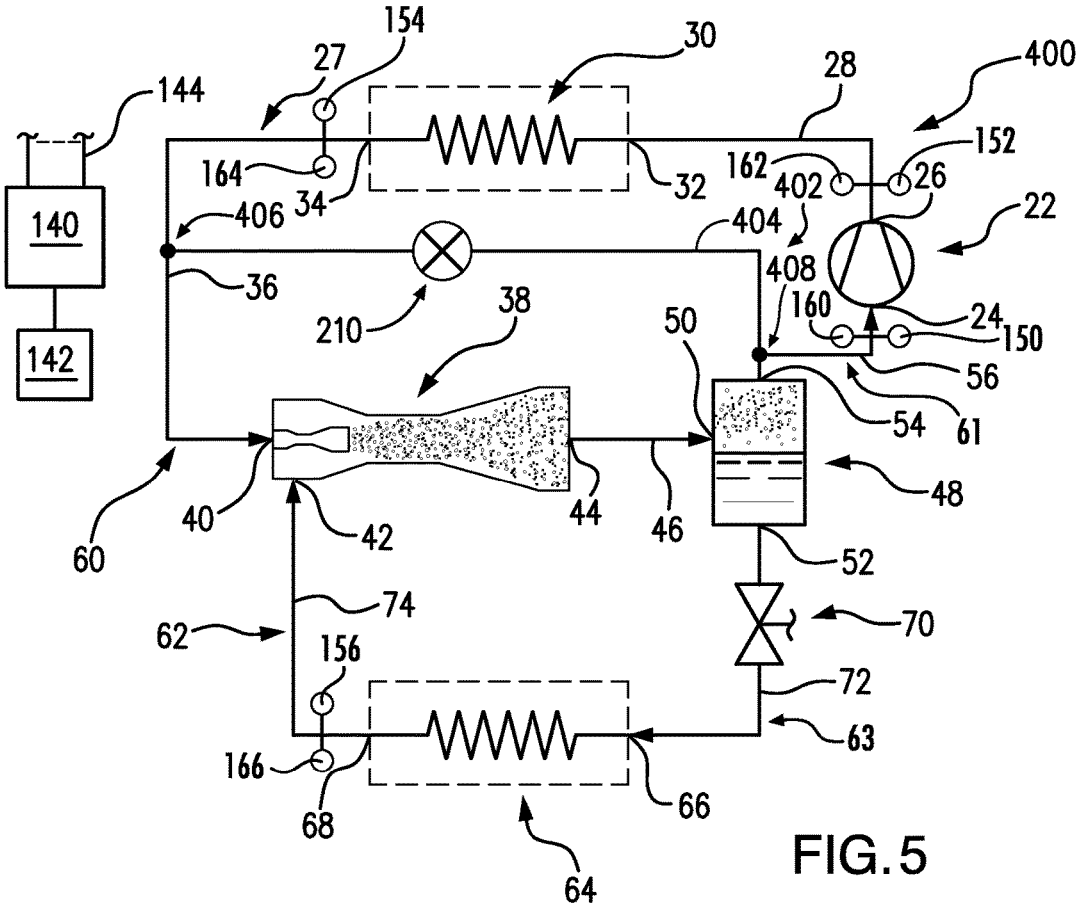
FIG. 5 is a schematic view of a fourth ejector refrigeration system.

FIG. 5 shows a system 400 which may be otherwise similar to the systems 200 and 300 having a line 404 extending from a similar upstream location 406 but to a downstream location 408. The exemplary downstream location 408 is, however, between the separator vapor outlet 54 and the compressor suction port 24 (e.g., along the suction line 56 and flowpath branch 61).

Control may be otherwise similar to that mentioned above for FIG. 3.

Some portion of the bypass refrigerant in FIG. 3 will proceed toward the evaporator 64, from the separator 48 and another portion will proceed to the compressor; and essentially all the bypass refrigerant in FIG. 4 proceeds to the evaporator. However, essentially all bypass refrigerant in FIG. 5 proceeds to the compressor, thus bypassing the second branch 63. In this embodiment, the bypass flow can be in fluid communication directly with the compressor inlet 24. Thus, relative to the Ozaki et al. embodiment bypassing to the separator, embodiments of the FIG. 5 system 400 may allow a smaller separator to be used.

Other potential advantages of the FIG. 5 system 400 relative to the Ozaki et al bypass to separator relate to compressor cooling. This may involve control processes different from those of the FIG. 3 and FIG. 4 systems. The system 400 can bypass relatively cool refrigerant to the compressor relatively cool refrigerant which may have non-negligible liquid phase. The comparatively low temperature refrigerant flowing through the bypass, plus the latent heat of vaporization, allow heat to be taken out of the compressor to limit compressor temperature and reduce the likelihood of damaging the compressor. Depending on particular details of construction, compressor damage may be experienced if it is operated above a threshold discharge temperature (e.g., the threshold discharge temperature for some compressors can be 265° F. to 330° F. (129° C. to 166° C.)). The exact threshold depends on operating condition, amount of circulating compressor coolant, compressor lubricant, compressor type, or a combination including at least one of the foregoing. In some embodiments, a limited amount of liquid refrigerant entering the compressor is not a problem for the compressor.

The controller may be programmed for allowing bypass to limit compressor temperature. This control may be in addition to control as discussed for the other systems. Control may be in response to a directly sensed temperature or a calculated temperature or a proxy thereof. For example, a discharge temperature sensor 152 may be coupled to the controller to provide discharge temperature data. Alternatively, the controller may be programmed to infer discharge temperature from other measurements (e.g., discharge and suction pressures from respective sensors 160 and 162 and suction temperature from sensor 150). The controller may be programmed to bypass refrigerant sufficiently to keep temperature at or below a threshold value. The threshold may be a set parameter, or the controller may be programmed to calculate a particular threshold for particular operating conditions. In one example of combined control, the controller may be programmed to bypass refrigerant if either the ejector flow or load exceeds a threshold (e.g., a pressure at the ejector (may be effectively measured by sensor 164 or a sensor closer to the ejector) or pressure difference across the ejector (e.g., may be measured between sensors 164 and 160 or sensors closer to the ejector) exceeds a threshold) or the compressor temperature (e.g., a discharge temperature from sensor 152) exceeds its threshold.

The FIG. 5 controller may be programmed to limit the amount of bypass to avoid the flooding of the compressor with liquid. The threshold for flooding may also be based on measured discharge temperature and/or other additional measured parameters such as suction and discharge pressures (from sensors 160 and 162) and suction temperature (from sensor 150). For example, the programming may indicate the desirability of bypassing motive flow to achieve a desired result such as improved ejector performance, improved system performance, or a combination thereof. In some embodiments, the programming may override efficiency based control and reduce or stop bypass flow if the controller does not find that a minimum temperature threshold is met.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Other variations common to vapor compression systems may also be implemented such as suction line heat exchangers, economizers, and the like. Systems having additional compressors, heat exchangers, or the like may also be implemented. Accordingly, other embodiments are within the scope of the following claims.

What is claimed is:

1. A vapor compression system (200; 300; 400) comprising:

a compressor (22);
a first heat exchanger (30);
a second heat exchanger (64);
an ejector (38) comprising:
a motive flow inlet (40);
a secondary flow inlet (42);
an outlet (44);
a control needle (132) movable between a first position and a second position; and
an actuator for controlling the movement of the control needle;
a separator (48) having:
an inlet (42);
a liquid outlet (52); and
a vapor outlet (54);
an expansion device (70); and
a plurality of conduits positioned to define a first flowpath sequentially through:
the compressor;
the first heat exchanger;
the ejector from the motive flow inlet through the ejector outlet; and
the separator, and then branching into:
a first branch returning to the compressor; and
a second branch passing through the expansion device and second heat exchanger to the secondary flow inlet, wherein:

the plurality of conduits are positioned to define a bypass flowpath (202; 302; 402) bypassing the motive nozzle and rejoining the first flowpath at a location selected from the group consisting of along:
the first flowpath upstream of the separator inlet;
the second branch downstream of the separator liquid outlet and upstream of the expansion device; and
the first branch downstream of the separator vapor outlet and upstream of the compressor inlet; and
the system further comprises means for controlling flow along the bypass flowpath independently of the actuator.

2. The vapor compression system (200) of claim 1 wherein:

the plurality of conduits are positioned so that the bypass flowpath rejoins the first flowpath upstream of the separator inlet.

3. The vapor compression system of claim 1 wherein:

the plurality of conduits are positioned so that the bypass flowpath rejoins the first flowpath upstream of the separator inlet a distance equal to four times to one hundred times an effective diameter of a flowpath entering the separator.

4. The vapor compression system (300) of claim 1 wherein:

the plurality of conduits are positioned so that the bypass flowpath rejoins the second branch downstream of the separator liquid outlet and upstream of the expansion device.

5. The vapor compression system (400) of claim 1 wherein:

the plurality of conduits are positioned so that the bypass flowpath rejoins the first branch downstream of the separator vapor outlet and upstream of the compressor inlet.

6. The vapor compression system of claim 1 wherein the actuator is a solenoid actuator.

7. The vapor compression system of claim 1 wherein the means comprises:

a pressure regulator disposed along the bypass flowpath.

8. The vapor compression system of claim 7 wherein:

the pressure regulator is a variable orifice expansion valve.

9. The vapor compression system of claim 1 wherein the means comprises:

a variable orifice electronic expansion valve disposed along the bypass flowpath.

10. The vapor compression system of claim 1 further comprising: wherein the means comprises:

a bistatic on-off valve disposed along the bypass flowpath.

11. The vapor compression system of claim 10 further comprising:

a controller (140) configured over at least a portion of an operating regime for pulse width modulated operation of the bistatic on-off valve.

12. The vapor compression system of claim 11 wherein the controller is configured to:

over said portion, increase the flow along the bypass flowpath responsive to increased high side pressure.

13. The vapor compression system of claim 11 wherein the controller is configured to:

over said portion, increase a fraction of the total flow passed along the bypass flowpath so as to reduce a compressor temperature.

14. The vapor compression system of claim 1 further comprising a controller (140) configured to, over at least a portion of an operating regime:

with increasing total flow through the heat rejection heat exchanger, increasing a fraction of the total flow passed along the bypass flowpath.

15. The vapor compression system of claim 1 wherein a refrigerant charge comprises at least 50% by weight carbon dioxide.

16. A method for operating the vapor compression system of claim 1, the method comprising, over at least a portion of an operating regime:

with increasing total flow through the heat rejection heat exchanger, increasing a fraction of the total flow passed along the bypass flowpath.

17. The method of claim 16 wherein:

the increasing the fraction of the total flow passed along the bypass flowpath is responsive to increased sensed high side pressure.

18. A method for operating the vapor compression system of claim 1, the method comprising, over at least a portion of an operating regime:

increasing a fraction of the total flow passed along the bypass flowpath so as to reduce a compressor temperature.

19. The method of claim 18 wherein:

the increasing the fraction of the total flow passed along the bypass flowpath is responsive to increased sensed compressor discharge temperature.

20. A method for operating the vapor compression system of claim 1 the method comprising, over at least a portion of an operating regime:

reducing flow restriction along the bypass flowpath while the control needle is positioned so that the motive nozzle fully open.

21. A vapor compression system (200; 300; 400) comprising:

a compressor (22);
a first heat exchanger (30);
a second heat exchanger (64);
an ejector (38) comprising:
a motive flow inlet (40);
a secondary flow inlet (42); and
an outlet (44);
a separator (48) having:
an inlet (42);
a liquid outlet (52); and
a vapor outlet (54);
an expansion device (70); and
a plurality of conduits positioned to define a first flowpath sequentially through:
the compressor;
the first heat exchanger;
the ejector from the motive flow inlet through the ejector outlet; and
the separator, and then branching into:
a first branch returning to the compressor; and
a second branch passing through the expansion device and second heat exchanger to the secondary flow inlet, further comprising:

means for unloading the ejector, the means comprising a bypass flowpath (202; 302; 402) bypassing the motive nozzle and rejoining the first flowpath at a location selected from the group consisting of along:
the first flowpath upstream of the separator inlet;
the second branch downstream of the separator liquid outlet and upstream of the expansion device; and
the first branch downstream of the separator vapor outlet and upstream of the compressor inlet.

* * * * *